United States Patent [19]

Suzuki et al.

[11] 4,154,080

[45] May 15, 1979

[54] MEANS FOR SUPPORTING ROLL CHOCKS IN A ROLLING MILL

[75] Inventors: Shigenobu Suzuki, Niihama; Motoo Asakawa, Kitakyushu, both of Japan

[73] Assignees: Sumitomo Metal Industries, Ltd., Osaka; Sumitomo Heavy Industries, Ltd., Tokyo, both of Japan

[21] Appl. No.: 843,278

[22] Filed: Oct. 18, 1977

[30] Foreign Application Priority Data

Nov. 12, 1976 [JP] Japan ..... 51-151980[U]

[51] Int. Cl.[2] ..... B21B 31/02

[52] U.S. Cl. ..... 72/237

[58] Field of Search ..... 72/237, 199, 35, 19, 72/21, 248, 245, 246, 244

[56] References Cited

U.S. PATENT DOCUMENTS

| | | | |
|---|---|---|---|
| 3,964,282 | 6/1976 | Stubbs et al. | 72/237 |
| 4,037,450 | 7/1977 | Gilvar | 72/237 |

*Primary Examiner*—Milton S. Mehr

*Attorney, Agent, or Firm*—Fleit & Jacobson

[57] ABSTRACT

There is disclosed an apparatus for supporting roll chocks of a work roll in a roll stand housing. This apparatus includes a thrust transmitting head member between the roll chock and a rolling force effecting mechanism such as a screw of a screw down mechanism. The head member has a spherical surface at one end in contact with a mating spherical surface formed at one end of the screw. These spherical surfaces have different radii to make point contact therebetween and to enable rolling contact movement between the head member and the screw in the rocking motion of the roll chock caused by a force in a workpiece generated during a rolling operation, to thereby provide more accurate measurement of tension in the workpiece being rolled by employing force sensing devices acting on the roll chocks. The head member also has inclined surfaces at the other end thereof in registration with mating inclined surfaces formed at one side of the roll chock. The registration of these mating inclined surfaces make it possible to center the roll chock in the roll stand housing.

9 Claims, 11 Drawing Figures

MEANS FOR SUPPORTING ROOL CHOCKS IN A ROLLING MILL

The present invention relates generally to rolling mills and more particularly to means for supporting a roll chock in a roll stand housing.

During the rolling operation in a continuous multi-stand rolling mill, if excessive compressive force acts on a workpiece between a given pair of stands of the rolling mill, the workpiece will tend to bow between the pair of stands and in an extreme case to deflect from the pass line of the rolling mill. On the other hand, if excessive tension acts on the workpiece between the pair of stands, the workpiece will tend to slip at the roll nip. In an extreme case, the workpiece will neck down or decrease in width and in thickness, and will often break. Variations in the inter-stand compressive and tensile force will cause trouble in the rolling mill operation and have detrimental effects on the rolled product gauge or shape.

In order to eliminate such inconvenience in the rolling operation, it has heretofore been known to be necessary to perform continuous measurement of forces in the workpiece between adjacent roll stands so that the rotating speeds of the rolls in such roll stands can be controlled in accordance with the results of the measurement so as to ceaselessly maintain the inter-stand force of the workpiece between the adjacent roll stands at a desired value. For this purpose, and in the case of materials being rolled of such thick gauges that loops cannot or can hardly be formed between adjacent roll stands, it has been proposed to mount at least one of the work rolls of one stand of the cooperating rolling stand pair and its associated roll chocks in the housing of said one stand for substantially free movement through very small distances in the direction of rolling and to provide a force sensing means in contact at its sensing end with said associated roll chock so as to directly measure forces or tensions in a workpiece which acts through said one work roll on said associated roll chock.

In conventional roll stands, however, roll chock supporting mechanisms did not have compatibility enough to provide sufficient rolling force transmitting capability and allow free movement of the associated roll chock in the direction of rolling without being subjected to substantial impeding load. For example, one recently proposed arrangement has a thrust transmitting head interposed between a work roll chock and a screw of a screw down mechanism, the thrust head and the screw having a complementary spherical engaging surface of the same radius so as to allow rocking motion of the roll chock relative to the screw. This spherical engagement between the thrust head and the screw is very effective in transmitting the rolling force from the screw of the screw down mechanism to the roll chock irrespective of the rocking motion of the roll chock. However, since the thrust head is in contact with the screw at substantially the whole spherical surfaces thereof, the surface contact friction between the head and the screw is considerably large and will tend to prevent the free rocking motion of the roll chock. This surface friction resistance can be large enough to compromise the sensitivity and accuracy of the above mentioned force sensing means.

In addition, very narrow clearances having substantially the same distance must be assured between the roll chock and the roll stand housing at the forward side and the rearward side in order to ensure free movement of the roll chock in the direction of rolling. However, since most conventional rolling stands have no means for precisely centering the roll chock in the roll stand housing, it has been very difficult and troublesome to position the roll chock in the housing so as to leave clearances of the same width at the forward and rearward sides of the roll chock.

It is therefore an object of the present invention to provide rolling mills having improved means for supporting roll chocks in a roll stand housing, in which the above mentioned inconveniences are eliminated.

Another object of the present invention is to provide rolling mills having means for supporting roll chocks in a roll stand housing, which have satisfactory rolling force transmitting capability and allow rocking motion of the roll chocks with minimized friction resistance so as to ensure the sensitivity and accuracy of tension measuring means.

A further object of the present invention is to provide rolling mills having means for centering a roll chock in the roll stand housing, whereby clearances of the same width can be easily provided at the forward and rearward sides of the roll chock so as to put the tension measuring means in an effectively operative condition.

Still another object of the present invention is to provide an improved rolling mill having means for supporting roll chocks in the roll stand housing to allow the roll chocks to rock with minimized friction resistance and means for centering the roll chocks in the roll stand housing.

The above and the other objects of the present invention are accomplished by a rolling mill including a roll stand in which a work roll is journalled for rotation between roll chocks which are in turn mounted in a roll stand housing to be movable in the direction of rolling. Each of the roll chocks is coupled through a thrust transmitting head member with means for effecting a rolling force in the work roll. The thrust transmitting head has a spherical surface formed at one end thereof in engagement with a mating spherical surface formed at one end of the rolling force effecting means. The mating spherical surfaces of the head member and the effecting means have different radii so as to make point contact between the head member and the rolling force effecting means whereby said roll chock can be rocked relative to the rolling force effecting means with minimized friction resistance. Means is provided for retaining the head member and the rolling force effecting means in cooperating relationship. Means is also provided for maintaining said head member in locked relationship with said roll chock. In one preferred embodiment of the present invention, the thrust transmitting head member has a spherical convex surface formed at the one end thereof and the rolling force effecting means has a spherical concave surface cooperating with the spherical convex of the head member, the spherical convex surface being of a radius smaller than that of the spherical concave surface. In the above embodiment, if the rolling force effecting means is a screw of a screw down mechanism, the screw has a spherical concave surface formed at the lower end thereof in engagement with a spherical convex surface formed at one end of the head member. If the above mentioned work roll is the lower work roll of a horizontal roll stand, the rolling force effecting means is a base portion of the roll stand housing. The base portion has a liner member mounted on the upper face thereof and having an upper spherical concave surface in engagement with a spherical convex surface formed at a lower end of the head member so as to support the head member and the lower roll chock.

In another preferred embodiment of the present embodiment, the above-mentioned rolling stand further includes means for holding the head member retaining member in a proper position. The means for maintaining the head member in locked relationship with the roll chock comprises inclined surface formed at the other end of the thrust transmitting head member and in registration with mating inclined surfaces formed on the roll chock. These mating inclined surfaces of the head member and the roll chock are out of parallel with the direction of rolling. When the roll chock is assembled into the roll stand housing, registration of the mating inclined surfaces between the roll chock and the head member serves to center the roll chock in the roll stand housing so that the roll chock has clearances of the same width between the roll chock and the roll stand housing at its forward and rearward sides. When a workpiece is being captured by the roll stand, the inclined surfaces of the head member are not only in registration with but also in intimate contact under a rolling pressure with the mating inclined surfaces of the roll chock, so that the head member and the roll chock are firmly locked with each other so as to prevent shear between the head member and the roll chock in the direction of rolling. As a result, the roll chock is allowed to rock together with the head member relative to the rolling force effecting means. In a specific embodiment of the present invention, the head member has a nose formed at the other end thereof and partially defined by a pair of inclined surfaces in parallel with the axis of the roll chock but out of parallel with the direction of rolling. The roll chock has a notch partially defined by a pair of inclined surfaces in complementary relation with the inclined surfaces of the head member.

The above and other objects and advantages of the present invention will become apparent from the following detailed descriptions of preferred embodiments with reference to the accompanying drawings, in which.

Figure 4:
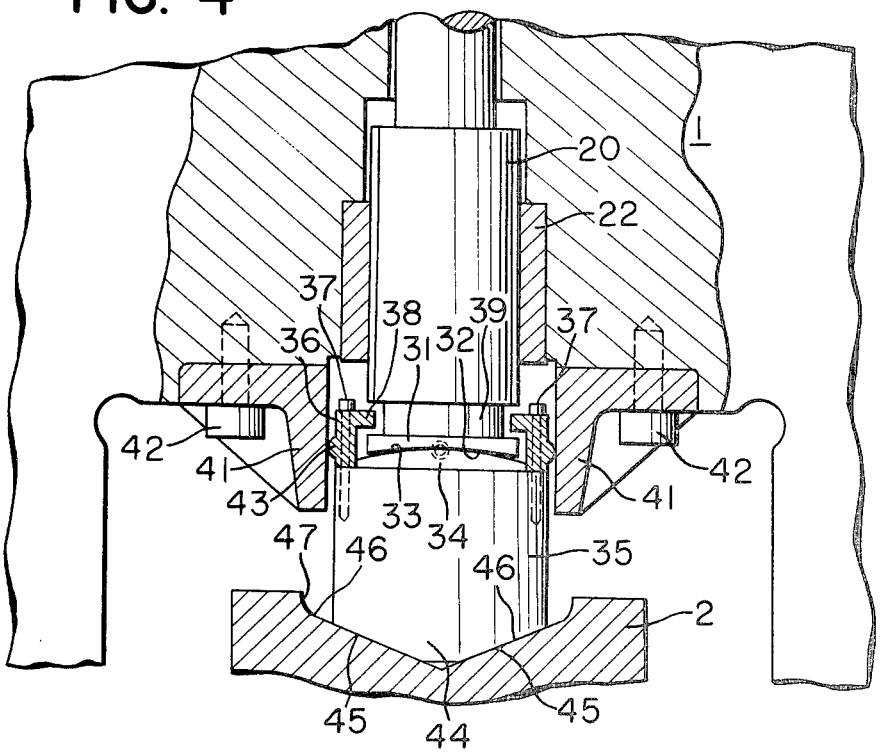
FIG. 4 is a view similar to FIG. 3 but showing a mechanism in accordance with the present invention for supporting a work roll chock in cooperation with a screw down mechanism.
Figure 4A:
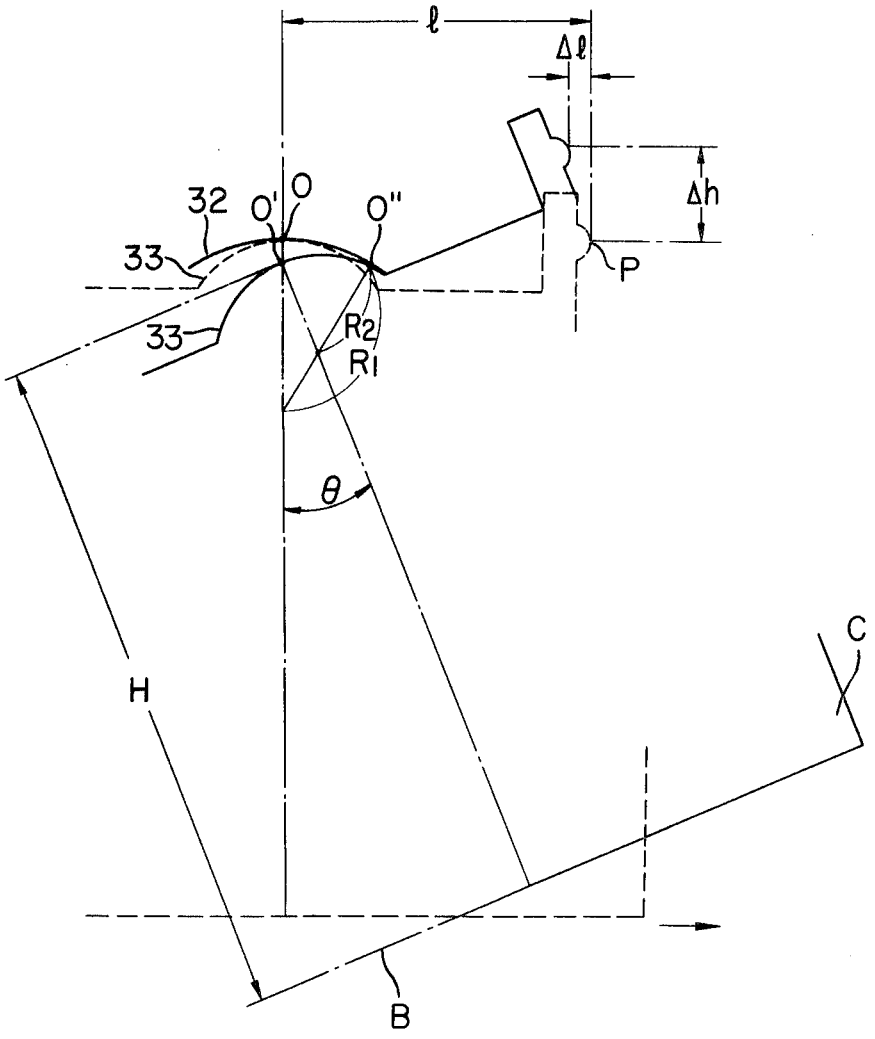
Figure 4B:
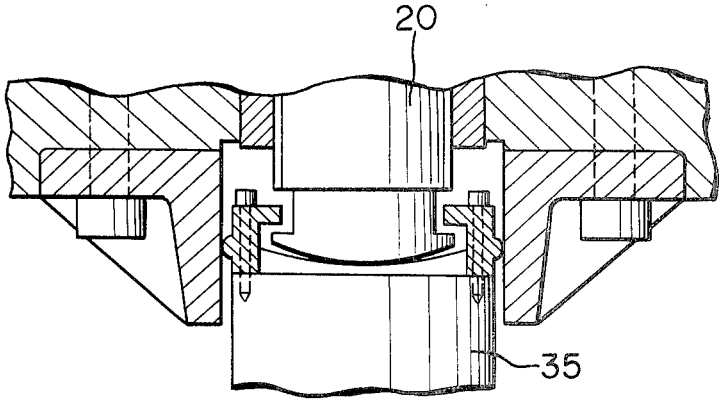
Figure 5:
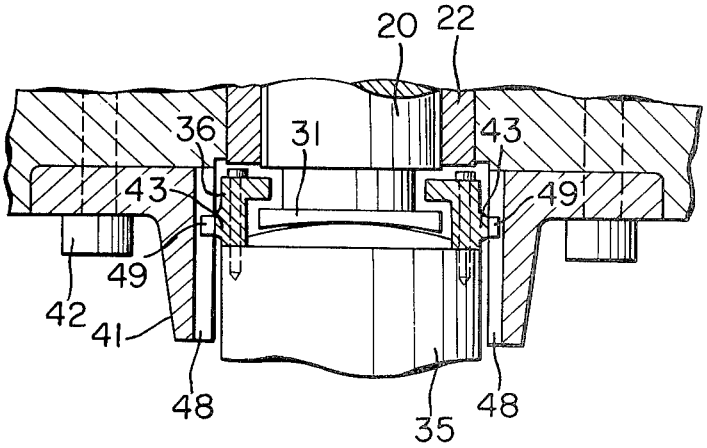
Figure 6:
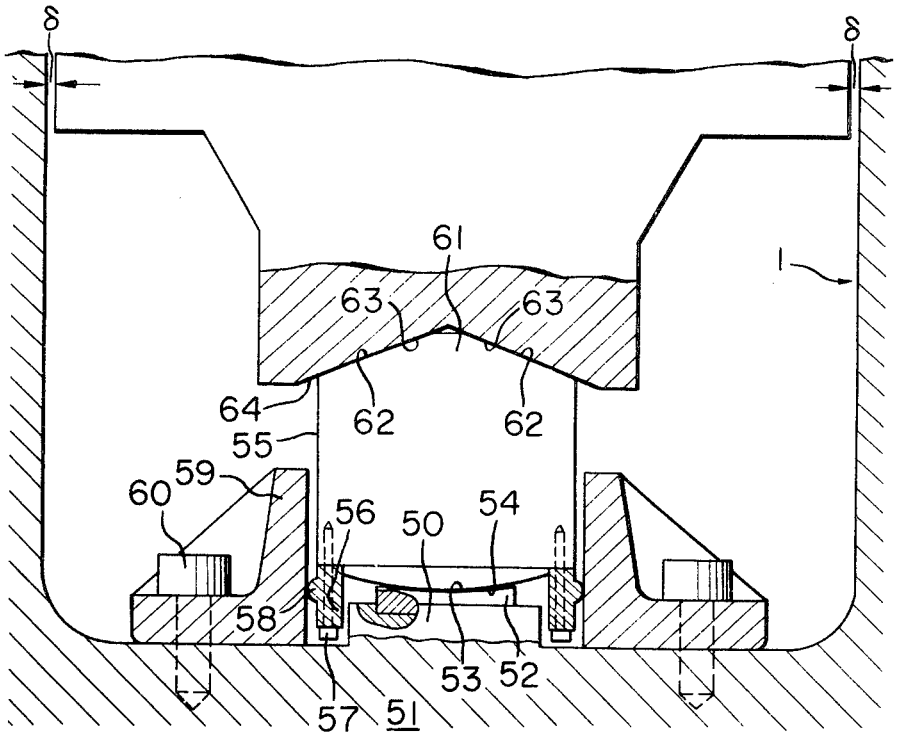
Figure 7:
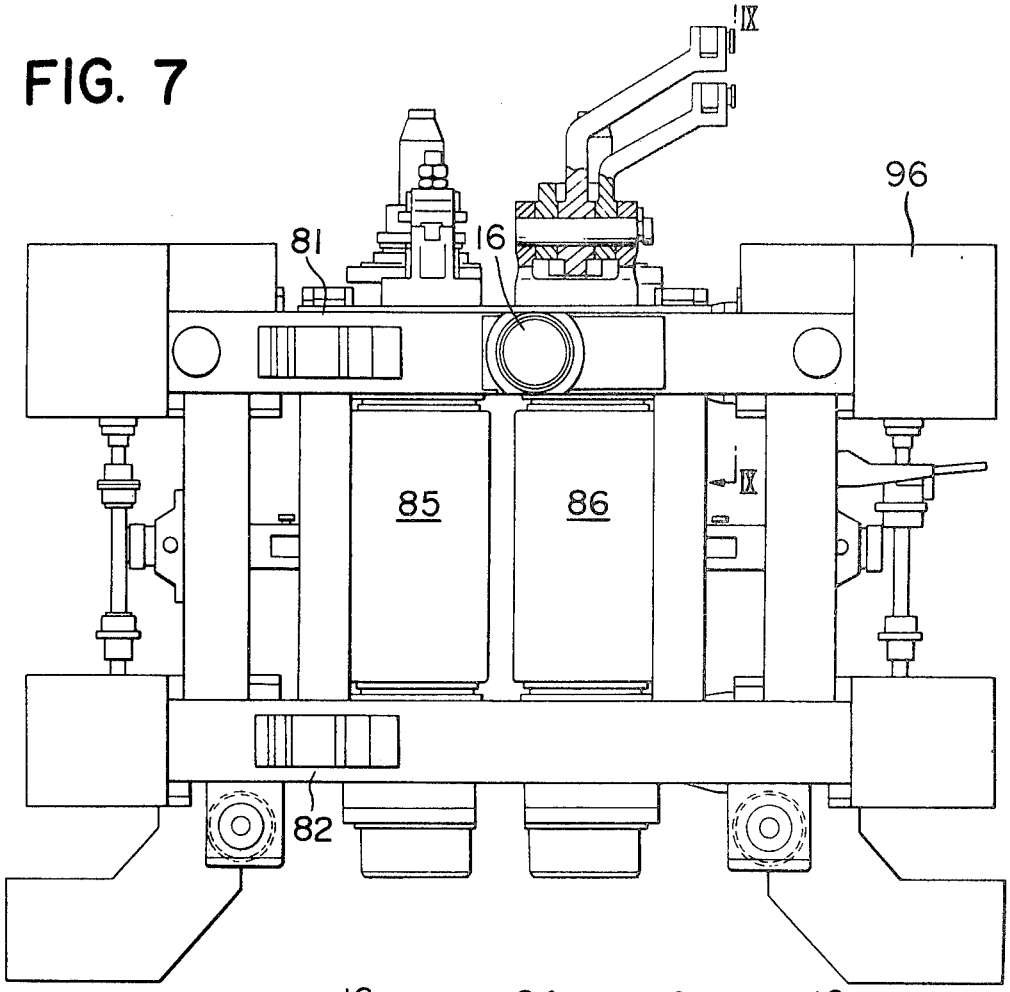
Figure 8:
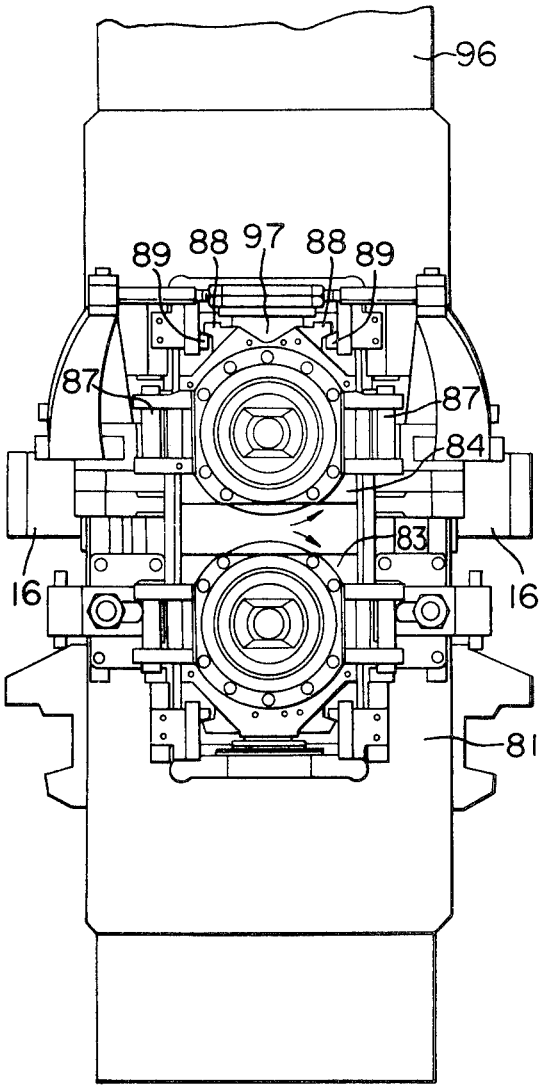

FIG. 4*a* illustrates the movement between the pair of spherical surfaces shown in FIG. 4;

FIG. 4*b* is another embodiment of the spherical supporting mechanism shown in FIG. 4;

FIG. 5 is a partial view, in section, showing a modification of the mechanism shown in FIG. 4;

FIG. 6 is an enlarged partial view, in section, showing a mechanism in accordance with the present invention for supporting a lower work roll chock;

FIG. 7 is a front view of a vertical roll stand embodying the features of the present invention;

FIG. 8 is a top view of the roll stand shown in FIG. 7; and

Figure 9:
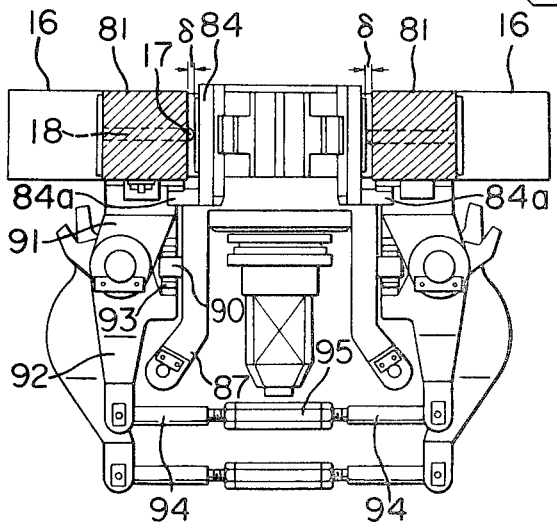

FIG. 9 is a vertical sectional view taken substantially along the line IX—IX in FIG. 7.

Figure 1:
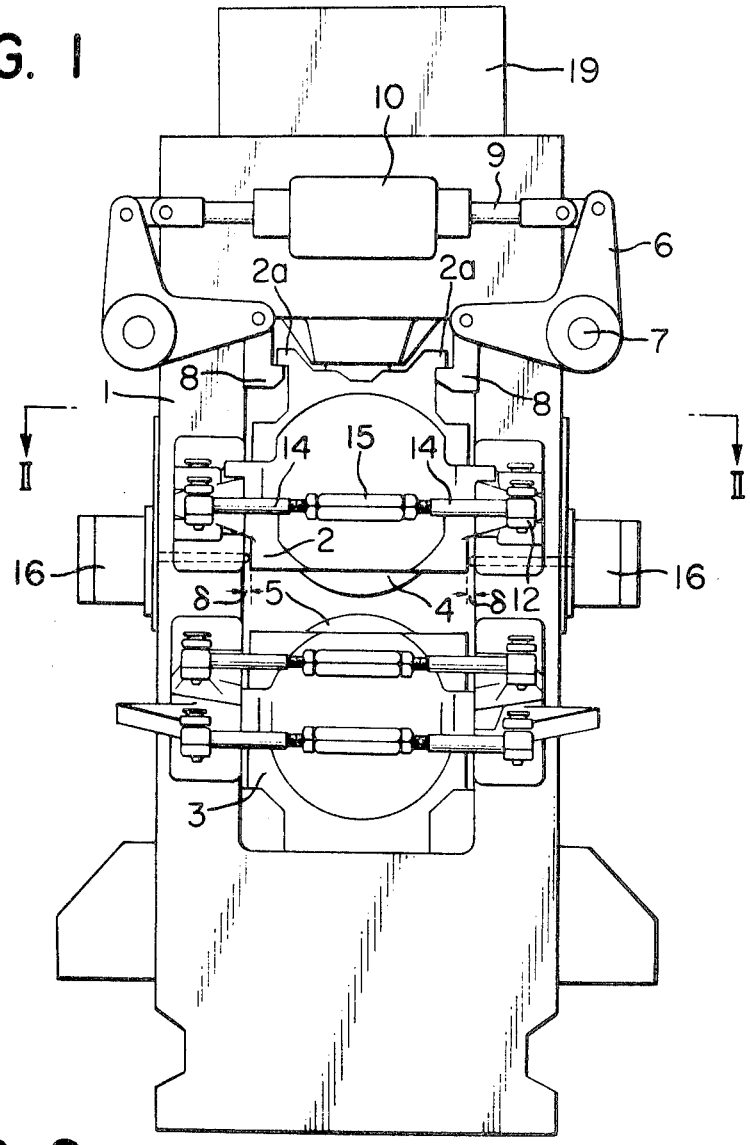
FIG. 1 is a side elevational view of a horizontal roll stand.
Figure 2:
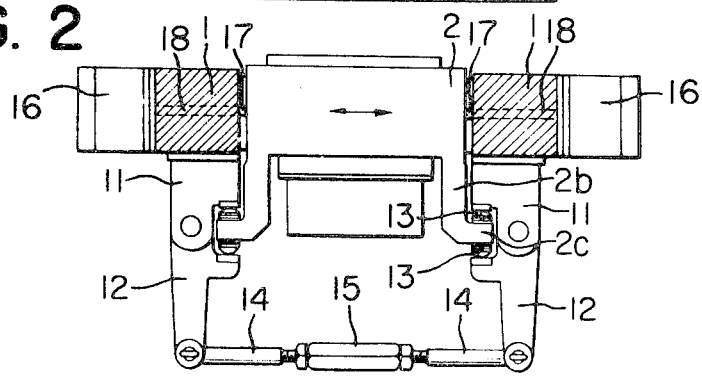
FIG. 2 is a horizontal sectional view taken substantially along the line II—II in FIG. 1.

Referring to the drawings, particularly to FIGS. 1 and 2, there is shown a roll stand of the horizontal type which includes a housing 1 and upper and lower roll chocks 2 and 3 for supporting upper and lower work rolls 4 and 5, respectively, at the opposite ends thereof. In this embodiment, the lower roll chocks 3 are mounted in the housing 1 in a manner conventional in the art.

Each upper roll chock 2 is resiliently suspended by a mechanism including a pair of bell-crank members 6 mounted on the housing 1 rotatably about horizontal shafts 7. Each bell-crank member 6 has, at one of its ends, a hook member 8 which engages a cooperating flange **2*a* formed on the upper roll chock 2 at the upper portion thereof. The other end of each bell-crank member 6 is connected through a rod 9 with a spring assembly 10 so that the upper roll chock 2 is resiliently forced upwardly under the action of the spring assembly 10. FIG. 1 shows one such mechanism provided at one axial end of the upper roll 4**. However, it should be noted that a similar mechanism is also provided at the other axial end.

The upper roll chock 2 is mounted in the housing 1 for movement within a limited extent parallel to the direction of the path of the workpiece. For this purpose, the roll chock 2 is located in the housing 1 with clearances $\delta$ at the forward and rearward sides. Furthermore, as shown in FIG. 2, the upper roll chock 2 is formed with a pair of L-shaped arms **2*b* having radially outwardly directed ends 2*c* which are positioned between bracket members 11 mounted on the housing 1 and clamping members 12 with interposition of metal pads or spacers 13. Recommendable material for such pads 13 is a laminated composite comprising a plurality of alternate metal and plastic laminae, as disclosed in U.S. Patent application Ser. No. 632,685, filed 1975 November 17th, assigned to Morgan Const. Co.. Tie rods 14 and a turnbuckel 15 are provided for maintaining the clamping member 12 in operative positions. In this mechanism, the metal pads 13 serve to constrain the associated roll chock 2 against movement in the direction of the axis of the roll but allow it to move parallel to the movement of the workpiece as shown by an arrow in FIG. 2**.

A screw down mechanism 19 is provided to apply a rolling force to the corresponding roll chock 2 through thrust transmitting means which will be described in detail hereinafter. For the purpose of measuring a force in the direction of rolling in a workpiece being rolled by the roll stand shown, a pair of force sensing devices 16 are provided on the housing 1 at the forward and rearward sides of the upper roll chock 2. The force sensing devices 16 are preferably of the type shown and described in detail in Toyohiko Okamoto et al's U.S. Pat. application Ser. No. 816,734 now U.S. Pat. No. 4,116,018 entitled "Rolling Mill" and filed July 18, 1977 to which reference may be made for a detailed description of such a force sensing device and is hereby incorporated herein by reference. The force sensing device 16 includes a force sensing rod 17 extending parallel to the direction of the pass line through a hole 18 formed in the housing 1, as shown in FIG. 2. One end of the rod 17 is adapted to contact with the upper roll chock 2 and the other end is coupled with a force sensing transducer such as a load cell (not shown) contained in the force sensing device 16, so that a force in the workpiece is transmitted to the load cell through the upper work roll and the associated roll chock. In order to ensure that the force sensing devices 16 detects the force in the workpiece, the roll chock 2 must be capable of moving in the direction of rolling as mentioned above. For this purpose, the above mentioned mechanism having the laminated pads 13 is provided and the clearances δ are provided at the forward and rearward sides of the roll chock 2. The clearances are ordinarily on the order of about one millimeter to several tenths of a millimeter in the direction of rolling. Furthermore, in order that the pair of force sensing devices 16 are maintained in the same sensible condition and are prevented from outputting erratic or unpredictable outputs, the minute clearances δ must be maintained to be substantially the same at both sides.

Figure 3:
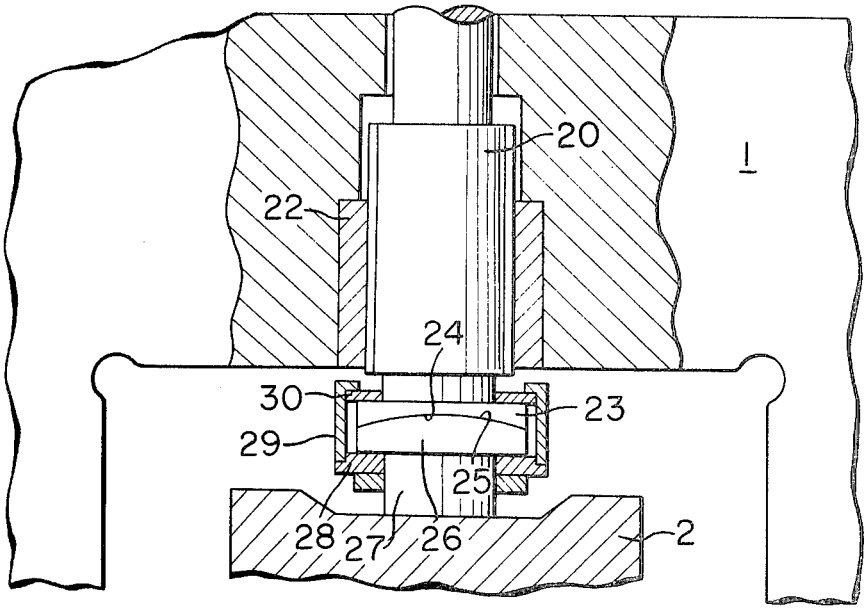
FIG. 3 is an enlarged partial view, in section, showing a conventional mechanism for supporting an upper work roll chock.

Referring to FIG. 3, there is shown a conventional means for transmitting a rolling force to the upper roll chock. The means includes a screw 20 of a screw down mechanism 19 (FIG. 1). The screw 20 is inserted in an internally threaded member 22 mounted on the housing 1. The screw 20 has a lower end 23 which has a spherical concave surface 24 in intimate contact with an upper spherical convex surface 25 formed on an upper end 26 of a thrust receiving member 27 which is in turn removably mounted at a lower flat end thereof on the top portion of the upper roll chock 2. The spherical concave and convex surfaces 24 and 25 have the same radius of curvature and therefore are contacted with each other substantially at the whole surface thereof. The thrust receiving member 27 has an annular member 28 fitted thereover and secured at a periphery thereof to a lower end of a sleeve member 29. The sleeve member 29 has an inward flange extending from the upper end thereof and in engagement with the lower end 23 of the screw 20 through a washer 30, so as to maintain the screw 20 and the thrust receiving member 27 in cooperative relationship. The rolling force is applied from the screw 20 of the screw down mechanism 19 and is transmitted through the whole contact interface between the spherical surfaces 23 and 24 and through the roll chock 2 to the work roll 4 without substantial loss. If a force is generated in a workpiece during rolling operation, the force acts through the work roll on the roll chock 2. Because the thrust receiving member 27 mounted on the roll chock 2 is coupled with the screw 20 of the screw down mechanism 19 through the spherical surfaces 23 and 24 having the same radius and in intimate contact with each other under rolling pressure, the force generated in the workpiece cannot move the roll chock linearly in the direction of the force but causes the roll chock to rock relative to the screw in the direction of the force. Since this rocking motion of the roll chock is very minute, the motion of the roll chock is substantially in the direction of rolling. However, since the rocking motion of the roll chock is attended by sliding contact movement between the spherical surfaces 23 and 24 at substantially the whole surface of contact, the frictional resistance between the surfaces 23 and 24 is relatively large and tends to prevent free rocking motion. In other words, the frictional resistance between the surfaces 23 and 24 is high enough to compromise the sensitivity and accuracy of the above mentioned force sensing devices 16. As mentioned above, the conventional means was effective in transmitting the rolling force to the work roll chock while allowing the rocking motion of the roll chock, but was disadvantageous in that the attendant frictional resistance is as large as to impair the sensitivity and accuracy of the force sensing device. In addition, the conventional roll stand has had no means for centering a roll chock in the roll stand housing, so that it was difficult and troublesome, although not impossible, to make the roll chock have minute clearances of the same width at the forward and rearward sides. In other words, it was difficult to assemble the roll chock into the roll stand housing so as to put the force sensing device pair in the same sensible condition.

Now, referring to FIG. 4, there is shown means for transmitting a rolling force to the work roll according to the present invention. This means includes the screw 20 of the screw down mechanism 19 (FIG. 1). The screw 20 is inserted in the internal threaded member 22 fitted into a hole of the housing 1. The screw 20 has a lower end 31 formed with a spherical concave surface 32 which is in engagement with a mating upper spherical convex surface 33 formed on an upper end 34 of a thrust transmitting head member 35. In the above points, the thrust transmitting means shown in FIG. 4 is similar to that shown in FIG. 3. However, the mating spherical surfaces 32 and 33 of the screw 20 and the thrust transmitting head member 35 have different radii of curvature so that the upper end 34 of the head member 35 makes point contact with the lower end 31 of the screw 20 at or in the vicinity of the center of the spherical concave surface 32.

A split retaining ring 36 is secured to the upper end of the head member 35 by means of bolts 37. The retaining ring 36 has an inwardly extending flange 38 formed at an upper portion thereof and adapted to be loosely received in a groove 39 formed in a lower portion of the screw 20. This retaining ring serves as means for removably attaching the head member 35 to the screw 20 and for retaining these two components in a cooperative relationship. The inward flange 38 of the retaining ring 36 has very slight clearances at the upper, lower and inner sides thereof, respectively, in order to allow the rocking motion of the head member 35 relative to the screw 20.

A collar member 41 is removably secured to the housing 1 by means of bolts 42. The collar member 41 surrounds the retaining ring 36 in such a manner that the inner surface of the collar member is in line contact with or in loose contact with an annular projection 43 which is formed on the outer surface of the retaining ring 36 and is semicircular in section. The collar member 41 acts to position the retaining ring member 36 and hence the head member 35 in alignment with the screw 20. When the head member causes rock motion, the ring member 36 is rocked with only two diametrically opposite points of the annular projection 43 being in contact with the inner surface of the collar member 41, resulting in no substantial friction resistance between the retaining ring 36 and the collar member 41 which would prevent the rocking motion.

The lower end of the head member 35 has a nose portion 44 partially defined by a pair of inclined surfaces 45 which is in turn adapted to engage with a pair of mating inclined surfaces 46 of a notch 47 formed at the top portion of the upper roll chock 2. These inclined surfaces 45 and 46 are in parallel with the axis of the roll chock 2 but are out of parallel with the pass line of the roll stand. The inclined surfaces 45 are parallel with or complementary to the opposed inclined surfaces 45. Registration of the nose 44 with the notch 47 acts to center the roll chock 2 in the roll stand housing 1 so that the roll chock has the normal working clearances of the same width δ between the roll chock and the housing at the forward and rearward sides when the roll chock is assembled into the housing. When a rolling operation is performed, the registration of the nose 44 with the notch 47 under the rolling pressure acts to maintain the roll chock 2 and the head member 35 in a locked relationship. In the other words, because of such registration, the roll chock 2 is prevented from translating relative to the head member 35 in the direction of rolling by a force generated in a workpiece during rolling operation, thereby enabling the roll chock to rock together with the head member relative to the screw 20 under influence of said force.

Next, the rocking motion of the roll chock will be briefly described with reference to FIG. 4*a* which illustrates the spherical surfaces 32 and 34 of the screw 20 and the head member 35 in an exaggerated manner. In FIG. 4*a*, the spherical concave surface 32 has a radius of $R_1$ and the spherical convex surface 33 has a radius of $R_2$ which is smaller than $R_1$. In a normal working operation, i.e., in "no tensen" rolling condition, the spherical concave surface 32 is in contact at its center point O with a center point O′ of the spherical convex surface 33, as shown in dotted line in FIG. 4*a*.

As mentioned hereinbefore, in order to ensure that the force sensing devices 16 are in such condition as to able to effectively measure the force in the workpiece, the clearances δ between the roll chock and the housing are sufficient if they are on the order of about one millimeter through several tenths of a millimeter. Assuming that the most remote corner C of the roll chock from the spherical surface 33 moves 0.6 millimeters rightwardly in FIG. 4*a* because of a force generated in a workpiece, the roll chock is rocked counterclockwise by rolling contact movement between the spherical surfaces 32 and 35, so that the contacting point between the spherical surfaces 32 and 33 shifts rightwardly along the spherical surface 32 to a point O″, as shown in solid line in FIG. 4*a*. Also, assuming that the height H from the bottom end B of the roll chock to the top end O′ of the spherical surface 33 is 825 mm, the rocking angle $\theta$ is about 0.0007 radian [$\tan^{-1}(0.6/825)$].

Further, assuming that the distance l between the center point O′ of the spherical convex 33 and a point P at the annular projection 43 of the ring member is 120 mm, the vertical moving height Δh of the point P under the rocking motion of about 0.0007 radian is about 0.05 mm, and the horizontal moving distance Δl of the point P is about 0.00003 mm. Therefore, in order to allow the rocking motion of the roll chock, the clearances between the groove 39 and the inwardly extending flange 38 are sufficient if they are at least about 0.05 mm at the upper and lower sides, respectively and at least about 0.00003 mm at the inside in the normal working condition. These clearances are very small as compared with the clearances δ required between the roll chock 2 and the housing 1. Therefore, the head member 35 which is attached to the screw 20 by means of the ring member 36 with the clearances as mentioned above and which is supported by the collar member 41 through the line contact or loose contact between the annular projection 43 and the collar member is substantially in alignment with the screw 20 at a high degree of accuracy and therefore enables registration of the inclined surfaces 45 with the mating inclined surfaces 46 to center the roll chock 2 in the housing at a high degree of accuracy, whereby the clearances δ of substantially the same width on the order of one millimeter through several tenths of a millimeter is given between the roll chock 2 and the housing 1 at the forward and rearward sides.

As mentioned hereinbefore, the spherical convex surface 33 of the head member 35 makes point contact with the spherical cancave surface 32 of the screw in the normal working condition, and when the roll chock 2 is subjected to a force in the direction of rolling, the head member 35 is rocked relative to the screw 35 by the rolling contact movement between the spherical surfaces 32 and 33. Therefore, the frictional resistance between the spherical surfaces 32 and 33 in the rocking motion of the roll chock is very slight and does not compromise the sensitivity and accuracy of the force sensing devices 16.

It will be understood that the smaller the difference between the radii $R_1$ and $R_2$ of the spherical surface 32 and 33 is, the larger the contacting area between the spherical surfaces becomes. The increase in the contacting area will enhance the tendency to prevent the rolling movement between the spherical surfaces 32 and 33 under rocking motion of the roll chock and instead causes the sliding movement between the contacted surfaces. This will result in increase in frictional resistance in the course of the rocking motion. On the other hand, the larger difference between the radii $R_1$ and $R_2$ results in decrease in the contacting area between the spherical surfaces 32 and 33. This will bring all rolling force to bear on the decreased contacting area which would result in damage or breakage of the force concentrated portions of the spherical surfaces 32 and 33. Therefore, the radii $R_1$ and $R_2$ of the spherical surfaces 32 and 33 should be suitably determined by experiment or theoretically. In the applicant's experiments, a desirable result was obtained upon $R_1$ of 580 mm and $R_2$ of 480 mm.

It should be understood that a similar effect can be obtained by reversing the contacting spherical surface relation between the screw 20 and the head member 35, as shown in FIG. 4*b*.

Since the spherical surface 32 of the screw 20 is in point contact at its center point O with the center point O′ of the spherical surface 33 of the head member in an unoperated condition, there is theoretically no possibility that rotation of the screw 20 for roll gap adjustment and the like rotates the head member 35. However, it is a actual fact that the rotation of the screw 20 causes the head member 35 to rotate slightly although it becomes no problem in much cases. In order to perfectly prevent the rotation of the head member 35 during operation of the screw 20, the collar member 41 may have inner vertical grooves 48 which receive ears 49 outwardly radially extending from the annular projection 43 of the ring member 36, as shown in FIG. 5.

Next, refering to FIG. 6, there is shown means in accordance with the present invention for supporting the lower roll chock 3 in the case that the aforementioned force sensing devices 16 are provided relative to the lower roll chocks of the horizontal roll stand. In this case, the lower roll chock 3 is mounted in the roll stand housing 1 with clearance δ between the lower roll chock and the housing at the forward and rearward sides. The housing 1 has a circular pedestal 50 formed at the lower base 51 of the housing 1. The pedestal 50 has a liner 52 embedded into the upper portion thereof. The liner 52 has a spherical upper concave surface 53 in contact with and in support relation with a spherical lower convex surface 54 of a thrust transmitting head member 55. A split ring member 56 is attached to the lower end of the head member 55 by means of bolts 57 and surrounds the spherical convex surface 54. The ring member 56 has an annular projection 58 in line contact with an inner surface of a collar member 59 which is in turn secured to the lower base 51 of the housing 1 by means of bolts 60. The line contact of the inner surface of the collar member 59 with the annular projection 58 acts to vertically position the head member 55, as in the case shown in FIG. 4. The spherical convex surface 54 has a radius smaller than that of the spherical concave surface 53 so as to provide point contact between these spherical surfaces, also similar to the case shown in and described with reference to FIG. 4.

The head member 55 has a nose portion 61 formed at the upper end thereof having a pair of inclined surfaces 62 which are in turn in registration with a pair of mating inclined surfaces 63 of a notch 64 formed at a lower end of the lower roll chock 3. These inclined surfaces 62 and 63 are in parallel with the axis of the lower roll chock 3 but are out of parallel with the pass line of the roll stand. The inclined surfaces 62 are parallel with or complementary to the opposed inclined surfaces 63, respectively. As in the case shown in FIG. 4, registration of the nose 61 with the notch 47 serves to center the lower roll chock 3 in the housing 1 so that the roll chock has the normal working clearances $\delta$ of the same width at the forward and rearward sides when the roll chock is assembled into the housing. This registration also serves to prevent the roll chock from translating relative to the head member in the direction of rolling but to allow the roll chock to rock together with the head member relative to the pedistal 50 when a force in the direction of rolling is generated in a workpiece being rolled.

Now, referring to FIGS. 7 through 9, there is shown a roll stand of the vertical type which incorporates therein a pair of the aforesaid force sensing devices 16. This roll stand includes upper and lower frames 81 and 82, and roll chocks 83 and 84 for supporting drive side and work side work rolls 85 and 86, respectively, at their opposite ends. In this embodiment, the drive side roll chocks 83 are mounted on the frames 81 and 82 in the conventional manner. On the other hand, the work side roll chocks are mounted on the frames 81 and 82 to be movable within a limited extent in the direction parallel to the pass line, in a manner similar to that of the upper roll chock 2 shown in FIGS. 1 and 2. The pair of the force sensing devices 16 are mounted on the forward and rearward sides of the upper frame 81 to measure a force in a workpiece under rolling transmitted through the upper work side roll chock 84.

To be brief, the upper work side roll chock 84 has a pair of hooks 87 for assembly and disassembly from the roll stand by suitable hoisting means (not shown). The upper roll chock 84 also has a pair of side flanges 88 formed at the side thereof opposite to the exposed portion of the work roll and adapted to engage, respectively, a pair of roll balance beams 89 formed on the frame. Further, the roll chock 84 includes a pair of outwardly extending portions **84*a* which are adapted to ride on the outer surface of the frame 81. The hook 87 has an outwardly extending portion 90 formed at an intermediate portion thereof and adapted to be interposed between a bracket member 91 and a clamping member 92 with interposition of pads or spacers 93. Tie rods 94 and a turnbuckle 95 are provided for maintaining the clamping members 92 in operative positions. The pads 93 serve to constrain the associated roll chock 84** against movement in the direction of axis of the roll but allows it to move in the direction parallel to the movement of the workpiece.

The upper work side roll chock 84 to which the aforesaid force sensing devices 16 are provided is mounted in the upper frame 81 to have clearances $\delta$ between the roll chock 84 and the frame 81 at the forward and rearward sides, as shown in FIG. 9. The upper roll chock 84 is applied with a rolling force from a screw down mechanism 96 through a thrust transmitting head member 97. This head member 97 is adapted to be coupled with the upper roll chock 84 and a screw (not shown) of the screw down mechanism 96 in a quite similar manner in all details to that shown in and described with reference to FIG. 4. To be brief, the head member 97 has a spherical surface formed at an outward end thereof and adapted to be in contact with a mating spherical surface formed at one end of the screw of the screw down mechanism 96. These mating spherical surfaces has different radii to make point contact therebetween. The head member is attached to the screw of the screw down mechanism 96 by means of the same split ring member as the ring member 36 in the same manner as that shown in and described with reference to FIG. 4. The head member 97 also has a nose formed at an inward end thereof and having a pair of inclined surfaces which are in turn in registration with a pair of mating inclined surfaces of a notch formed at an outward side of the upper roll chock 84.

It can thus be understood that in the vertical roll stand, it is possible to allow the rocking motion of the roll chock without substantial friction resistance and to center the roll chock in the frame so as to have the same clearances at both sides.

It will thus be seen that, according to the present invention, it is possible to facilitate rocking movement of the roll chocks of a work roll through minute distances in the direction of rolling to thereby provide more accurate measurement of workpiece tension by means of force sensing devices acting on the roll chocks. It is also possible to center the roll chocks in a roll stand so as to have substantial the same clearances between the roll chock and the roll stand at the forward and rearward sides, whereby the paired force sensing devices are put in the same operating condition so as not to output unpredictable measured values.

The present invention has been shown and described with reference to specific embodiments, however, it should be noted that the invention is in no way limited to the details of the illustrated structures but changes and modifications may be made within the scope of the appended claims.

We claim:

1. In a rolling mill including a roll stand in which a work roll is journalled for rotation between roll chocks which are in turn mounted to be movable in the direction of rolling, each of the roll chocks being coupled with means for effecting a rolling force in the roll chock, the improvement comprising:

a thrust transmitting head member between said roll chock and said rolling force effecting means, said head member having a spherical surface formed at one end thereof in engagement with a mating spherical surface formed at one end of said rolling force effecting means, said mating spherical surfaces having different radii to make point contact between said head member and said rolling force effecting means whereby said roll chock can be rocked with minimized friction resistance;

means for retaining said head member and said rolling force effecting means in cooperating relationship; and means for maintaining said head member in locked relationship with said roll chock.

2. The apparatus according to claim 1 wherein said head member has a spherical convex surface formed at one end thereof in engagement with a spherical concave surface formed at one end of said rolling force effecting means, said spherical convex surface having a radius smaller than that of said spherical concave surface.

3. The apparatus according to claim 2 wherein said rolling force effecting means is a screw of a screw down mechanism, said screw having a spherical concave surface formed at the lower end thereof.

4. The apparatus according to claim 2 wherein said rolling force effecting means is a base portion of the roll stand housing, said base portion having a liner member mounted thereon and having a spherical concave surface formed at the upper side thereof.

5. The apparatus according to claim 1 wherein said retaining means includes a ring member mounted on the one end of said head member and having an inwardly extending flange which is loosely received in an annular groove formed at the one end of said rolling force effecting means.

6. The apparatus according to claim 1 further including means for holding said retaining means in a proper position, and wherein said maintaining means comprises inclined surfaces formed at the other end of said head member in registration with mating inclined surfaces formed on said roll chock, registration of the mating inclined surfaces between said head member and said roll chock serving to center said roll chock in the roll stand housing when said roll chock is assembled into the stand housing and to maintain said head member and said roll chock in a locked relationship when a workpiece is being captured by the roll stand.

7. The apparatus according to claim 6 wherein said inclined surfaces formed on said head member are a pair of inclined surfaces which partially define a nose formed at the other end of said head member and which are parallel to the axis of said roll chock but are out of parallel to the mill pass line, and wherein said mating inclined surfaces formed on said roll chock are a pair of inclined surfaces which partially define a notch formed on said roll chock and which are complementary to said pair of inclined surfaces formed on said head member.

8. The apparatus according to claim 7 wherein said retaining means includes a ring member mounted on the one end of said head member and adapted to partially receive the one end of said rolling force effecting means, and wherein said holding means is a collar member mounted on the roll stand housing and surrounding said retaining ring member with its inner surface in loose contact with an annular projection formed on the outside surface of said retaining ring member so as to hold said ring member in a proper position without substantial friction resistance.

9. The apparatus according to claim 8 wherein said retaining ring member has second projections formed at the outside surface thereof and adapted to cooperate with axially extending grooves formed on the inner surface of said holding collar member so as to prevent rotation of said ring member and hence said head member.

* * * * *